US008840378B2

(12) United States Patent
Tanaka et al.

(10) Patent No.: US 8,840,378 B2
(45) Date of Patent: Sep. 23, 2014

(54) THRUST GENERATING APPARATUS

(75) Inventors: Masahito Tanaka, Osaka (JP); Hiromitsu Kiyose, Kobe (JP); Tetsuro Ikebuchi, Kobe (JP); Kentaro Nakagawa, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 394 days.

(21) Appl. No.: 13/379,688

(22) PCT Filed: Jun. 18, 2010

(86) PCT No.: PCT/JP2010/004080

§ 371 (c)(1),
(2), (4) Date: Mar. 5, 2012

(87) PCT Pub. No.: WO2010/150499

PCT Pub. Date: Dec. 29, 2010

(65) Prior Publication Data

US 2012/0156070 A1 Jun. 21, 2012

(30) Foreign Application Priority Data

Jun. 25, 2009 (JP) ..... 2009-150524

(51) Int. Cl.
*F04D 29/64* (2006.01)
*B63H 1/14* (2006.01)

(52) U.S. Cl.
CPC ..... *B63H 1/14* (2013.01)
USPC ..... 417/356

(58) Field of Classification Search
CPC ... F04D 13/086; F04D 25/06; F05B 2220/32; B63H 2020/00; B63H 2021/12; B63H 2003/005; B63H 2001/16; B63H 2001/14; B63H 1/20
USPC ..... 417/356, 423.7, 423.14, 423.15, 417/423.12; 310/87; 440/6; 416/3
See application file for complete search history.

(56) References Cited

U.S. PATENT DOCUMENTS 4,629,033 A * 12/1986 Moore et al. ..... 184/6.3
5,209,650 A * 5/1993 Lemieux ..... 417/356

(Continued)

FOREIGN PATENT DOCUMENTS

| | | |
|---|---|---|
| JP | A-59-160699 | 9/1984 |
| JP | A-07-187081 | 7/1995 |
| JP | A-2001-151197 | 6/2001 |

OTHER PUBLICATIONS

International Search Report in International Application No. PCT/JP2010/004080; dated Sep. 7, 2010 (with English-language translation).

*Primary Examiner* — Bryan Lettman
(74) *Attorney, Agent, or Firm* — Oliff PLC

(57) ABSTRACT

A thrust generating apparatus is configured to generate thrust by ejecting water. The thrust generating apparatus includes: a first water lubricated bearing opposed to one side surface and outer peripheral surface of rotor main body and supports a thrust and radial load; a second water lubricated bearing opposed to the other side surface and outer peripheral surface of rotor main body and supports the thrust and radial load; a first water intake port that opens toward a portion of a channel; a second water intake port that opens toward another portion of the channel; a first water conveyance tube through which the water having flowed through the first water intake port is guided to the second water lubricated bearing; and a second water conveyance tube through which the water having flowed through the second water intake port is guided to the first water lubricated bearing.

5 Claims, 5 Drawing Sheets

(56) References Cited

U.S. PATENT DOCUMENTS 5,490,768 A 2/1996 Veronesi et al.
6,692,319 B2 2/2004 Collier et al.
6,837,757 B2 * 1/2005 Van Dine et al. ..... 440/6
2003/0186601 A1 10/2003 Collier et al.

* cited by examiner

THRUST GENERATING APPARATUS

RELATED APPLICATION

This application claims priority to and the benefit of Japanese Patent Application No. 2009-150524, filed in Japan Patent Office on Jun. 25, 2009, the entire disclosure of which is incorporated herein by reference.

TECHNICAL FIELD

The present invention relates to a thrust generating apparatus configured to generate propulsive force of, for example, a vessel.

BACKGROUND ART

In recent years, due to shortage of energy resources and the like, it has been required to improve the efficiency of a propulsion system configured to generate a propulsive force in a vessel. In the propulsion system of the vessel, a diesel engine has the most excellent heat efficiency among various prime movers, and the propulsion system in which the diesel engine is coupled directly or via a reducer to a propeller as a propulsor is now the mainstream. However, it has been pointed out that the diesel engine has an air pollution problem in terms of environmental performance. As an environmental countermeasure of the diesel engine, an electric propulsion system configured to rotate the propeller by an electric motor to generate the propulsive force has been attracting attention. For example, U.S. Pat. No. 6,692,319 discloses a ring-shaped propulsion device for submarine vessels, the propulsion device being configured such that propeller blades projecting in a radially inward direction are provided on a rotor of a ring-shaped electric motor. According to this propulsion device, by the rotation of the propeller blades driven by the electric motor, water stream is ejected to produce the propulsive force.

SUMMARY OF INVENTION

Technical Problem

In the case of the propulsion device in which the propeller blades are driven by the electric motor, heat loss occurs by heat generation of the electric motor, and this deteriorates the efficiency. Therefore, in the electric propulsive system, how to cool the heat generated by the electric motor is important. Here, the electric motor is integrated in the ring-shaped propulsion device. Therefore, if a cooling device for cooling the electric motor is added, the propulsion device becomes complex in configuration and increases in size, which is not desirable.

An object of the present invention is to provide a thrust generating apparatus configured to have an excellent cooling performance by a simple configuration.

Solution to Problem

A thrust generating apparatus according to the present invention is a thrust generating apparatus provided in a liquid and configured to generate thrust by ejecting the liquid, the thrust generating apparatus including: an annular stator at which a plurality of coils are provided; a rotor capable of rotating positively and negatively and including a plurality of magnets, a rotor core to which the magnets are attached and which is constituted by a magnetic body, and an annular rotor main body to which the rotor core is attached; a propeller blade provided on a radially inner side of the rotor main body and formed integrally with the rotor main body; a first liquid lubricated bearing provided on one side of the rotor main body, opposed to one side surface and outer peripheral surface of the rotor main body, and configured to support a thrust load and a radial load; a second liquid lubricated bearing provided on the other side of the rotor main body, opposed to the other side surface and outer peripheral surface of the rotor main body, and configured to support the thrust load and the radial load; a first liquid intake port configured to open toward a portion of a channel, the portion being located on one side of the propeller blade; a second liquid intake port configured to open toward another portion of the channel, the another portion being located on the other side of the propeller blade; a first liquid conveyance tube through which the liquid having flowed through the first liquid intake port is guided to the second liquid lubricated bearing; and a second liquid conveyance tube through which the liquid having flowed through the second liquid intake port is guided to the first liquid lubricated bearing.

According to the above configuration, when the propeller blade positively rotates, the liquid is ejected from one side of the propeller blade toward the other side, and the pressure at the second liquid intake port becomes high. Therefore, by the pressure difference, the liquid is supplied from the second liquid intake port through the second liquid conveyance tube to the first liquid lubricated bearing. When the propeller blade negatively rotates, the liquid is ejected from the other side of the propeller blade to the one side, and the pressure at the first liquid intake port becomes high. Therefore, by the pressure difference, the liquid is supplied from the first liquid intake port through the first liquid conveyance tube to the second liquid lubricated bearing. On this account, according to the above configuration in which the propeller blade rotates positively and negatively together with the rotor, the sliding surfaces of the first liquid lubricated bearing and the rotor main body and the sliding surfaces of the second liquid lubricated bearing and the rotor main body can be lubricated by the liquid, and the rotor core which is provided in the vicinity of the sliding surfaces and generates heat by eddy current can be cooled by the liquid.

Since the liquid is ejected from one side of the propeller blade to the other side by the positive rotation of the propeller blade, its reaction force causes the propeller blade and the rotor to move from the other side to the one side in a direction toward the first liquid lubricated bearing. However, at this time, the liquid is supplied from the second liquid intake port through the second liquid conveyance tube to the first liquid lubricated bearing as described above. Therefore, the portion between the first liquid lubricated bearing and the rotor main body is suitably lubricated. Since the liquid is ejected from the other side to the one side in a direction along the rotation axis line of the propeller blade by the negative rotation of the propeller blades, its reaction force causes the propeller blade and the rotor to move from the one side to the other side in a direction toward the second liquid lubricated bearing. However, at this time, the liquid is supplied from the first liquid intake port through the first liquid conveyance tube to the second liquid lubricated bearing as described above. Therefore, the portion between the second liquid lubricated bearing and the rotor main body is suitably lubricated. On this account, according to the above configuration in which the propeller blade rotates positively and negatively together with the rotor, the high-specific-pressure portion which changes depending on the rotational direction can be surely lubricated by a simple configuration.

A check valve configured to allow only the flow of the liquid from the first liquid intake port toward the second liquid lubricated bearing may be provided at the first liquid conveyance tube, and another check valve configured to allow only the flow of the liquid from the second liquid intake port toward the first liquid lubricated bearing may be provided at the second liquid conveyance tube.

According to the above configuration, one-way flow of water from the first liquid intake port toward the second liquid lubricated bearing and one-way flow of water from the second liquid intake port toward the first liquid lubricated bearing are ensured. Therefore, the liquid is unlikely to remain in the first and second liquid conveyance tubes, and the cooling performance improves.

The stator may include: an outer casing; an inner casing provided on an inner periphery side of the outer casing; a cooling space formed between the outer casing and the inner casing; and communication ports through which the cooling space communicates with a main channel where the propeller blade is provided.

According to the above configuration, since the liquid flowing through the main channel is guided through the communication ports to the cooling space in the stator, heat generating members, such as the coil, can be cooled by the liquid in the cooling space. In addition, since the cooling space communicates through the communication ports with the main channel where new water flows, the temperature increase of the liquid in the cooling space can be suppressed. Therefore, the cooling performance can be improved by a simple configuration without providing any special cooling device.

The communication ports may be respectively provided on both sides of the propeller blade.

According to the above configuration, when the propeller blade rotates, the pressure on the downstream side of the propeller blade becomes higher than the pressure on the upstream side of the propeller blade. Therefore, the liquid in the main channel flows into the cooling space through the communication port provided downstream of the propeller blade, and the liquid in the cooling space flows out to the main channel through the communication port provided upstream of the propeller blade. Therefore, by the pressure difference, the liquid is prevented from remaining in the cooling space, and the cooling performance can be improved.

The outer casing may be formed in a duct shape, the inner casing may include fairings respectively provided on both sides of the rotor main body and each formed in a funnel shape so as to enlarge a diameter thereof in a direction away from the rotor main body, and gaps as the communication ports may be respectively formed between the outer casing and a large-diameter end portion of one of the fairings and between the outer casing and a large-diameter end portion of the other fairing.

According to the above configuration, by forming the gap between the outer casing and the outer end portion of the fairing, the communication port which connects the main channel and the cooling space can be formed. Therefore, the cooling performance can be improved by a simple configuration.

DESCRIPTION OF EMBODIMENTS

Hereinafter, embodiments of the present invention will be explained in reference to the drawings.

Embodiment 1

Figure 1:
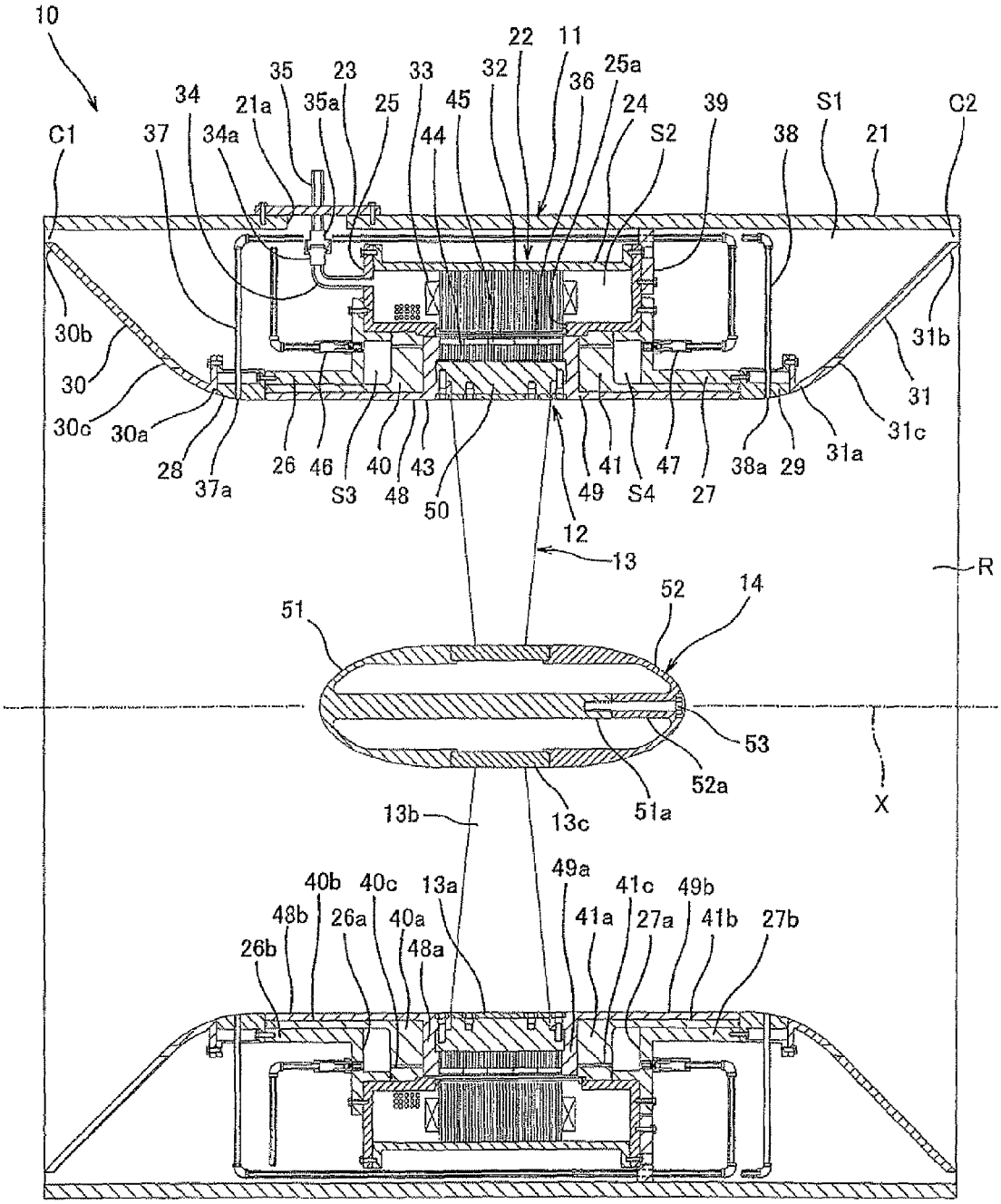
FIG. 1 is a longitudinal sectional view showing a thrust generating apparatus according to Embodiment 1 of the present invention.
Figure 2:
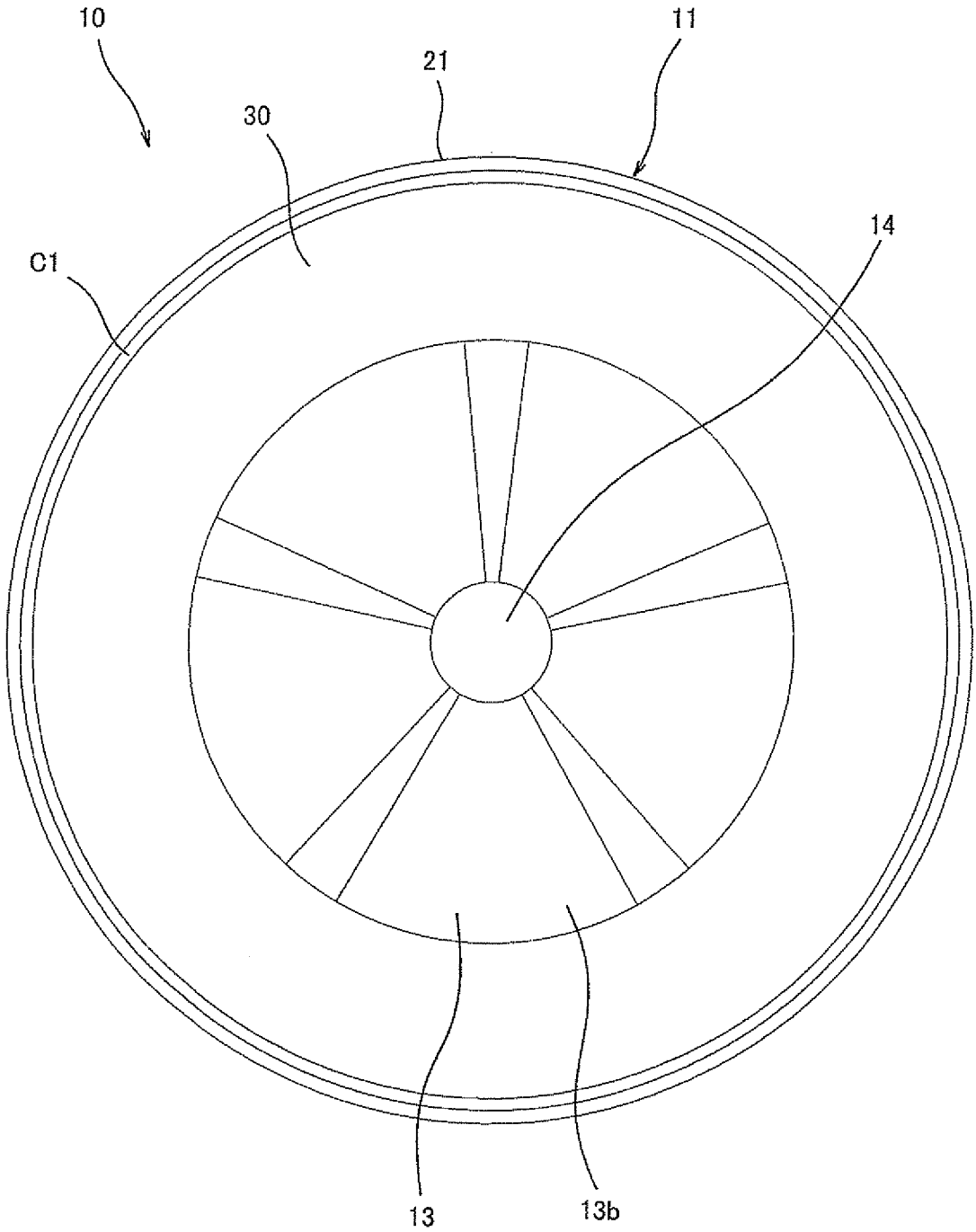
FIG. 2 is a diagram showing the thrust generating apparatus of FIG. 1 when viewed from a left side in FIG. 1.

As shown in FIGS. 1 and 2, a thrust generating apparatus 10 of Embodiment 1 includes: an annular stator 11 fixed to a hull; an annular rotor 12 capable of rotating positively and negatively relative to the stator 11; a propeller member 13 formed integrally with the rotor 12 on a radially inner side of the rotor 12; and a boss 14 formed integrally with a radially inner tip end of the propeller member 13 and provided on a rotation axis line X of the rotor 12.

The stator 11 includes an annular outer casing 21 and an annular inner casing 22 provided on an inner periphery side of the outer casing 21. A substantially cylindrical space formed between the outer casing 21 and the inner casing 22 is a cooling space S1. The outer casing 21 is a cylindrical duct on which a cable through hole 21*a* is partially formed. The cable through hole 21*a* is closed by a lid 23. The inner casing 22 is formed by coupling first to fourth casings 24 to 27, support rings 28 and 29, and fairings 30 and 31 by bolts. The inner casing 22 (specifically, the second casing 25) is detachably fixed by bolts to a bracket 39 projecting from the outer casing 21 in a radially inward direction. The bracket 39 is provided partially in a circumferential direction and does not divide the cooling space S1.

The first casing 24 and the second casing 25 are coupled to each other by bolts and forms a coil accommodating space S2. In the coil accommodating space S2, a stator core 32 constituted by a magnetic body as a magnetic flux path is provided, and armature coils 33 wind around the stator core 32. The armature coils 33 are connected via electric cables 34 and 35 to a power supply (not shown) provided in the hull. The electric cables 34 and 35 are coupled to each other in the cooling space S1 by water proof connectors 34*a* and 35*a*. The electric cable 35 on the hull side penetrates the lid 23 in a watertight manner. An annular cutout portion 25*a* is formed at a portion of the second casing 25, the portion corresponding to an inner peripheral surface of the stator core 32. The annular cutout portion 25*a* is closed by a thin can 36 in a watertight manner, the can 36 being made of a material which has an insulation property and a water resisting property and is small in eddy current loss.

The third casing 26 includes: a flange portion 26*a* fixed to the second casing 25 by bolts; and a cylindrical portion 26*b* extending in an outward direction along the rotation axis line X from an inner peripheral end of the flange portion 26*a*, and the fourth casing 27 includes a flange portion 27*a* fixed to the second casing 25 by bolts; and a cylindrical portion 27*b* extending in the outward direction along the rotation axis line X from an inner peripheral end of the flange portion 27*a*. A pair of support rings 28 and 29 are respectively fixed to outer end portions of the cylindrical portions 26*b* and 27*b* by bolts. The support ring 28 supports one end portion of a first water conveyance tube 37 (liquid conveyance tube), and the support ring 29 supports one end portion a second water conveyance tube 38 (liquid conveyance tube). A first water intake port 37*a* (liquid intake port) that is an opening at one end portion of the first water conveyance tube 37 is located on the same surface as an inner peripheral surface of the support ring 28 and is open toward a main channel R, and a second water intake port 38*a* (liquid intake port) that is an opening at one end portion of the second water conveyance tube 38 is located on the same surface as an inner peripheral surface of the support ring 29 and is open toward the main channel R (In FIG. 1, the second water conveyance tube 38 is partially not shown at a portion where the second water conveyance tube 38 overlaps the first water conveyance tube 37, and the first water conveyance tube 37 is partially not shown at a portion where the first water conveyance tube 37 overlaps the connectors 34*a* and 35*a*.).

The fairing 30 is formed so as to increase in diameter in a direction from an inner end portion 30*a* located close to the support ring 28 toward an outer end portion 30*b* located away from the support ring 28, and the fairing 31 is formed so as to increase in diameter in a direction from an inner end portion 31*a* located close to the support ring 29 toward an outer end portion 31*b* located away from the support ring 29. The inner end portions 30*a* and 31*b* of the fairings 30 and 31 are respectively fixed to the support rings 28 and 29 by bolts. To be specific, the fairings 30 and 31 and the outer casing 21 are indirectly, detachably integrated with one another. Gaps C1 and C2 are respectively formed between the outer end portion 30*b* of the fairing 30 and the outer casing 21 and between the outer end portion 31*b* of the fairing 31 and the outer casing 21. A hole 30*c* is formed on the fairing 30 so as to be located at a position overlapping an extended axis line of the bolt by which the fairing 30 is fixed to the support ring 28, and a hole 31*c* is formed on the fairing 31 so as to be located at a position overlapping an extended axis line of the bolt by which the fairing 31 is fixed to the support ring 29. The gaps C1 and C2 and the holes 30*c* and 31*c* serve as communication ports through which the cooling space S1 communicates with the main channel R.

First and second water lubricated bearings 40 and 41 (liquid lubricated bearings) are provided between the stator 11 and the rotor 12, and the rotor 12 is rotatably supported. Each of the first and second water lubricated bearings 40 and 41 is provided on an outer peripheral surface and one of both side surfaces of a below-described rotor main body 43 so as to be opposed to each other, the side surfaces being opposed to each other in the direction along the rotation axis line X. The first and second water lubricated bearings 40 and 41 support a thrust load and a radial load acting on the rotor main body 43. The first water lubricated bearing 40 includes a flange portion 40*a* and a cylindrical portion 40*b* extending in the outward direction along the rotation axis line X from an inner peripheral end of the flange portion 40*a*, and the second water lubricated bearing 41 includes a flange portion 41*a* and a cylindrical portion 41*b* extending in the outward direction along the rotation axis line X from an inner peripheral end of the flange portion 41*a*. Ceramic is sprayed on sliding surfaces of the first water lubricated bearing 40 on which the rotor main body 43 slides, and ceramic is sprayed on sliding surfaces of the second water lubricated bearing 41 on which the rotor main body 43 slides. Each of the first and second water lubricated bearings 40 and 41 may be made as a ceramic solid, or a separate ceramic member may be attached to each of a sliding portion of the first water lubricated bearing 40 on which the rotor main body 43 slides and a sliding portion of the second water lubricated bearing 41 on which the rotor main body 43 slides.

An annular buffer space S3 for temporarily storing water is formed between the first water lubricated bearing 40 and the third casing 26, and an annular buffer space S4 for temporarily storing water is formed between the second water lubricated bearing 41 and the fourth casing 27. The other end portion of the second water conveyance tube 38 is connected to the third casing 26 via a check valve 46, and the other end portion of the first water conveyance tube 37 is connected to the fourth casing 27 via a check valve 47. The channel in the second water conveyance tube 38 communicates with the buffer space S3 via the check valve 46, and the channel in the first water conveyance tube 37 communicates with the buffer space S4 via the check valve 47. The check valve 46 allows only the flow from the second water intake port 38*a* toward the first water lubricated bearing 40, and the check valve 47 allows only the flow from the first water intake port 37*a* toward the second water lubricated bearing 41. Therefore, the water flowing through the first water intake port 37*a* into the first water conveyance tubes 37 is guided to the buffer space S4 through the check valve 47, and the water flowing through the second water intake port 38*a* into the second water conveyance tube 38 is guided to the buffer space S3 through the check valve 46. A plurality of ejection holes 40*c* are formed on the flange portion 40*a* of the first water lubricated bearing 40 so as to be spaced apart from one another in the circumferential direction at regular intervals. One end of each of the ejection holes 40*c* communicates with the buffer space S3, and the other end thereof is open toward the rotor main body 43. Similarly, a plurality of ejection holes 41*c* are formed on the flange portion 41*a* of the second water lubricated bearing 41 so as to be spaced apart from one another in the circumferential direction at regular intervals. One end of each of the ejection holes 41*c* communicates with the buffer space S4, and the other end thereof is open toward the rotor main body 43.

The rotor 12 includes: the rotor main body 43; an annular rotor core 44 which externally fits the rotor main body 43 and is made of a magnetic body to which a corrosion resistant coating is applied; and permanent magnets 45 which are attached to the rotor core 44 and on which the magnetic force of the armature coils 33 act. The rotor core 44 and the stator core 32 are provided at positions opposed to each other. By changing how to supply electricity to the armature coils 33, the rotational direction of the rotor 12 can be reversed. The rotor main body 43 includes: a first member 48 including the side surface and outer peripheral surface opposed to the first water lubricated bearing 40; a second member 49 including the side surface and outer peripheral surface opposed to the second water lubricated bearing 41; and a third member 50 including a supporting surface contacting an inner peripheral surface of the rotor core 44.

The first to third members 48 to 50 are detachably fixed to one another by bolts. The first member 48 includes a flange portion 48*a* and a cylindrical portion 48*b* extending in the outward direction along the rotation axis line X from an inner peripheral end of the flange portion 48*a*, and the second member 49 includes a flange portion 49*a* and a cylindrical portion 49*b* extending in the outward direction along the rotation axis line X from an inner peripheral end of the flange portion 49*a*. An outer side surface of the flange portion 48*a* of the first member 48 in the direction along the rotation axis line X is a thrust sliding surface opposed to the flange portion 40*a* of the first water lubricated bearing 40, and an outer side surface of the flange portion 49*a* of the second member 49 in the direction along the rotation axis line X is a thrust sliding surface opposed to the flange portion 41*a* of the second water lubricated bearing 41. An outer peripheral surface of the cylindrical portion 48*b* of the first member 48 is a radial sliding surface opposed to the cylindrical portion 40*b* of the first water lubricated bearing 40, and an outer peripheral surface of the cylindrical portion 49*b* of the second member 49 is a radial sliding surface opposed to the cylindrical portion 41*b* of the second water lubricated bearing 41. To be specific, the third member 50 does not include sliding surfaces which slide on the first and second water lubricated bearings 40 and 41. All the sliding surfaces of the rotor main body 43 are formed on the first and second members 48 and 49 configured to be attached to and detached from the third member 50 by bolts. Each of the flange portions 48*a* and 49*a* of the first and second members 48 and 49 projects in a radially outward direction beyond the third member 50. The rotor core 44 externally fits by an annular recess formed by the flange portions 48*a* and 49*a* of the first and second members 48 and 49 and an outer peripheral surface (supporting surface) of the third member 50.

The propeller member 13 is detachably fixed to an inner peripheral surface of the third member 50 by bolts. The propeller member 13 includes: an outer cylindrical portion 13*a* which internally fits and is fixed to the third member 50; a plurality of propeller blades 13*b* projecting in the radially inward direction from an inner peripheral surface of the outer cylindrical portion 13*a* so as to be spaced apart from one another in the circumferential direction at regular intervals; and an inner cylindrical portion 13*c* to which radially inner tip ends of the plurality of propeller blades 13*b* are connected. The inner cylindrical portion 13*c* is sandwiched between a pair of warhead-shaped separable bosses 51 and 52 such that both ends of the inner cylindrical portion 13*c* in the direction along the rotation axis line X respectively contact large-diameter ends of the separable bosses 51 and 52. Each of the separable bosses 51 and 52 gradually decreases in diameter toward its tip end. One separable boss 51 includes therein a bolt attaching portion 51 a including a bolt hole which is open toward the other side, and the other separable boss 52 includes a bolt attaching portion 52*a* including a bolt hole corresponding to the bolt hole of the bolt attaching portion 51*a*. By inserting a bolt 53 into the bolt holes of the bolt attaching portions 51*a* and 52*a*, the separable bosses 51 and 52 are integrated with each other so as to compressively sandwich the inner cylindrical portion 13*c*. Thus, the boss 14 that is a streamlined hollow member which gradually decreases in diameter toward both sides in the direction along the rotation axis line X is formed by the inner cylindrical portion 13*c* and the separable bosses 51 and 52. Then, by suitably detaching the bolts, the rotor main body 43, the propeller blades 13*b*, and the separable bosses 51 and 52 can be separated from one another.

The main channel R where the propeller blades 13*b* are provided are defined by inner peripheral surfaces of the outer cylindrical portion 13*a*, the first and second members 48 and 49, the support rings 28 and 29, and the fairings 30 and 31. The main channel R includes a columnar portion; and diameter increasing portions, each of which is continuously formed from one of both ends of the columnar portion in the direction along the rotation axis line X and increases in diameter toward one of both directions along the rotation axis line X. Each of the first and second water intake ports 37*a* and 38*a* is located at a boundary portion between the columnar portion and one of the diameter increasing portions.

Figure 3:
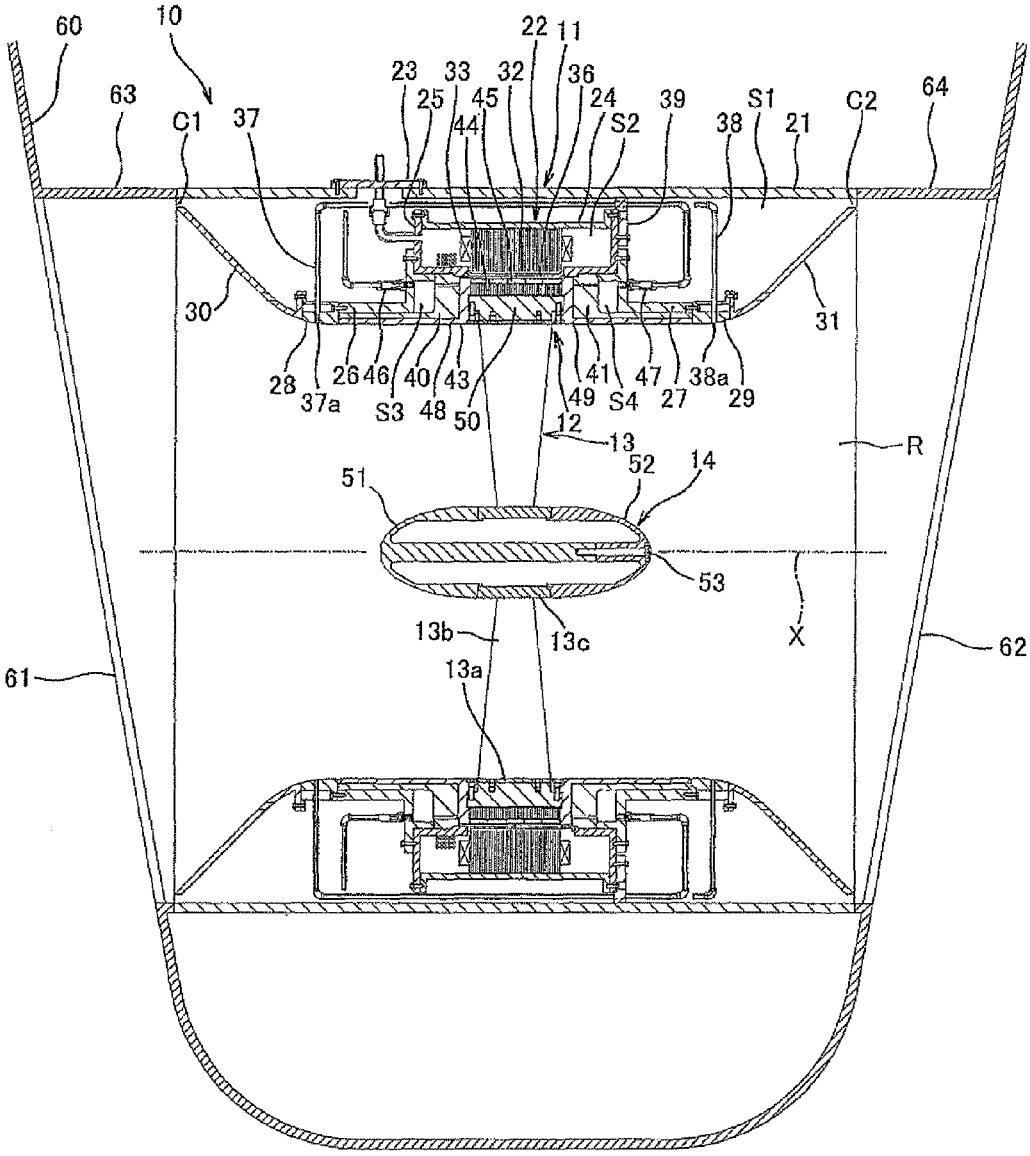
FIG. 3 is a cross-sectional view for explaining a state where the thrust generating apparatus of FIG. 1 is mounted on a hull.

The thrust generating apparatus 10 is attached to a movable body configured to be movable relative to the water on or under the water. For example, the thrust generating apparatus 10 is applied as a side thruster configured to generate thrust in the left-right direction of a large vessel. Specifically, as shown in FIG. 3, a hull 60 includes openings 61 and 62 penetrating in the left-right direction. A cylindrical wall 63 projects from the opening 61 toward the inside of the hull, and a cylindrical wall 64 projects from the opening 62 toward the inside of the hull. Opposing ends of the pair of cylindrical walls 63 and 64 are spaced apart from each other, and both ends of the outer casing 21 of the thrust generating apparatus 10 are respectively welded and fixed to these opposing ends of the cylindrical walls 63 and 64.

Next, operations of the thrust generating apparatus 10 will be explained. When the magnetic field generated by supplying electricity to the armature coils 33 acts on the permanent magnets 45, the rotor 12, the propeller member 13, and the boss 14 integrally rotate. When the propeller blades 13*b* positively rotate, the water is ejected from the propeller blades 13*b* toward the right side in FIG. 1. Therefore, the pressure in the vicinity of the second water intake port 38*a* becomes higher than the pressure on the left side (upstream side) of the propeller blades 13*b* in FIG. 1. By this pressure difference, the water in the main channel R flows through the second water intake port 38*a* into the second water conveyance tube 38 without a pump, and the water in the second water conveyance tube 38 is guided through the check valve 46 to the buffer space S3. Then, the water in the buffer space S3 is ejected from the ejection hole 40*c* to the first member 48 of the rotor main body 43. This water lubricates and cools the sliding surfaces of the first member 48 and the first water lubricated bearing 40, and a part of the water flows through the gap between the first member 48 and the support ring 28 into the main channel R. The remaining water flows through the gap between an outer peripheral surface of the rotor core 44 and the can 36 to lubricate and cool the sliding surfaces of the second member 49 and the second water lubricated bearing 41. Since the water is ejected from the propeller blades 13*b* toward the right side in FIG. 1 by the positive rotation of the propeller blades 13*b*, its reaction force causes the rotor main body 43 to move from the right side to the left side in FIG. 1 in a direction toward the first water lubricated bearing 40. However, the water having flowed through the second water intake port 38*a* into the second water conveyance tube 38 at this time is ejected through the ejection hole 40*c* of the first water lubricated bearing 40 toward the rotor main body 43. Therefore, the rotor main body 43 can be supported by the ejected water, and the portion between the first water lubricated bearing 40 and the rotor main body 43 is suitably lubricated.

In contrast, when the propeller blades 13*b* negatively rotate, the water is ejected from the propeller blades 13*b* toward the left side in FIG. 1. Therefore, the pressure in the vicinity of the first water intake port 37*a* becomes higher than the pressure on the right side (upstream side) of the propeller blades 13*b* in FIG. 1. By this pressure difference, the water in the main channel R flows through the first water intake port 37*a* into the first water conveyance tube 37 without a pump, and the water in the first water conveyance tube 37 is guided through the check valve 47 to the buffer space S4. Then, the water in the buffer space S4 is ejected from the ejection hole 41*c* to the second member 49 of the rotor main body 43. This water lubricates and cools the sliding surfaces of the second member 49 and the second water lubricated bearing 41, and a part of the water flows through the gap between the second member 49 and the support ring 29 into the main channel R. The remaining water flows through the gap between the outer peripheral surface of the rotor core 44 and the can 36 to lubricate and cool the sliding surfaces of the first member 48 and the first water lubricated bearing 40. Since the water is ejected from the propeller blades 13*b* toward the left side in FIG. 1 by the negative rotation of the propeller blades 13*b*, its reaction force causes the rotor main body 43 to move from the left side to the right side in FIG. 1 in a direction toward the second water lubricated bearing 41. However, the water having flowed through the first water intake port 37*a* into the first water conveyance tube 37 at this time is ejected through the ejection hole 41*c* of the second water lubricated bearing 41 toward the rotor main body 43. Therefore, the rotor main body 43 can be supported by the ejected water, and the portion between the second water lubricated bearing 41 and the rotor main body 43 is suitably lubricated.

According to the above configuration in which the propeller blades 13*b* rotate positively and negatively together with the rotor 12, the sliding surfaces of the first water lubricated bearing 40 and the rotor main body 43 and the sliding surfaces of the second water lubricated bearing 41 and the rotor main body 43 can be lubricated by the water, and the rotor core 44 and the like which are provided in the vicinity of the sliding surfaces and generate heat by eddy current can be cooled by the water. Portions where specific pressure increases when the propeller blades 13*b* positively rotate (that is, the sliding surfaces of the first member 48 and the first water lubricated bearing 40) are different from portions where specific pressure increases when the propeller blades 13*b* negatively rotate (that is, the sliding surfaces of the second member 49 and the second water lubricated bearing 41). However, the portions where the specific pressure is high can be accurately lubricated in accordance with the rotational direction of the propeller blades 13*b* by a simple configuration.

Since the check valve 47 is provided at the first water conveyance tube 37, and the check valve 46 is provided at the second water conveyance tube 38, one-way flow of water from the first water intake port 37*a* toward the second water lubricated bearing 41 and one-way flow of water from the second water intake port 38*a* toward the first water lubricated bearing 40 are ensured, and the water is unlikely to remain in the first and second water conveyance tubes 37 and 38. Thus, a cooling performance improves. Further, the water flowing in the main channel R enters through the communication ports that are the gaps C1 and C2 and the holes 30*c* and 31*c* into the cooling space S1 formed between the outer casing 21 and the inner casing 22. Therefore, the coils 33, the stator core 32, the rotor core 44, and the like can be cooled by the water in the cooling space S1. In addition, since the cooling space S1 communicates with the main channel R where new water flows, the temperature increase of the water in the cooling space S1 can be suppressed. The gaps C1 and C2 and the holes 30*c* and 31*c* that are the communication ports are separately provided upstream and downstream of the propeller blades 13*b*. Therefore, the replacement of water in the cooling space S1 is accelerated by this pressure difference.

Next, maintenance work of the thrust generating apparatus 10 will be explained. For example, when the first and second members 48 and 49 or the first and second water lubricated bearings 40 and 41 are replaced with new ones due to the deteriorations of the sliding surfaces of the first and second water lubricated bearings 40 and 41 and the rotor main body 43, the bolts are suitably detached to disassemble the fairings 30 and 31, the support rings 28 and 29, and the third and fourth casings 26 and 27. This realizes easy access to the first and second water lubricated bearings 40 and 41 and the rotor main body 43.

Regarding the rotor main body 43, the first and second members 48 and 49 are detected from the third member 50 by suitably detecting the bolts, and the new first and second members 48 and 49 are fixed to the third member 50. With this, it is unnecessary to pull out the rotor core 44 from the third member 50, and the replacement work of all the sliding surfaces of the rotor main body 43 can be performed while maintaining a state where the rotor core 44 externally fits the third member 50. Therefore, it is unnecessary for an operator to worry about peel-off of the corrosion resistant coating of the rotor core 44, and the ease of maintenance improves.

The rotor main body 43, the propeller member 13, and the separable bosses 51 and 52 are detachably fixed to one another by bolts. Therefore, for example, when the propeller blades 13*b* break, the propeller member 13 is detached from the rotor main body 43 and the separable bosses 51 and 52 and can be easily replaced with a new one. Thus, the ease of maintenance improves.

Embodiment 2

Figure 4:
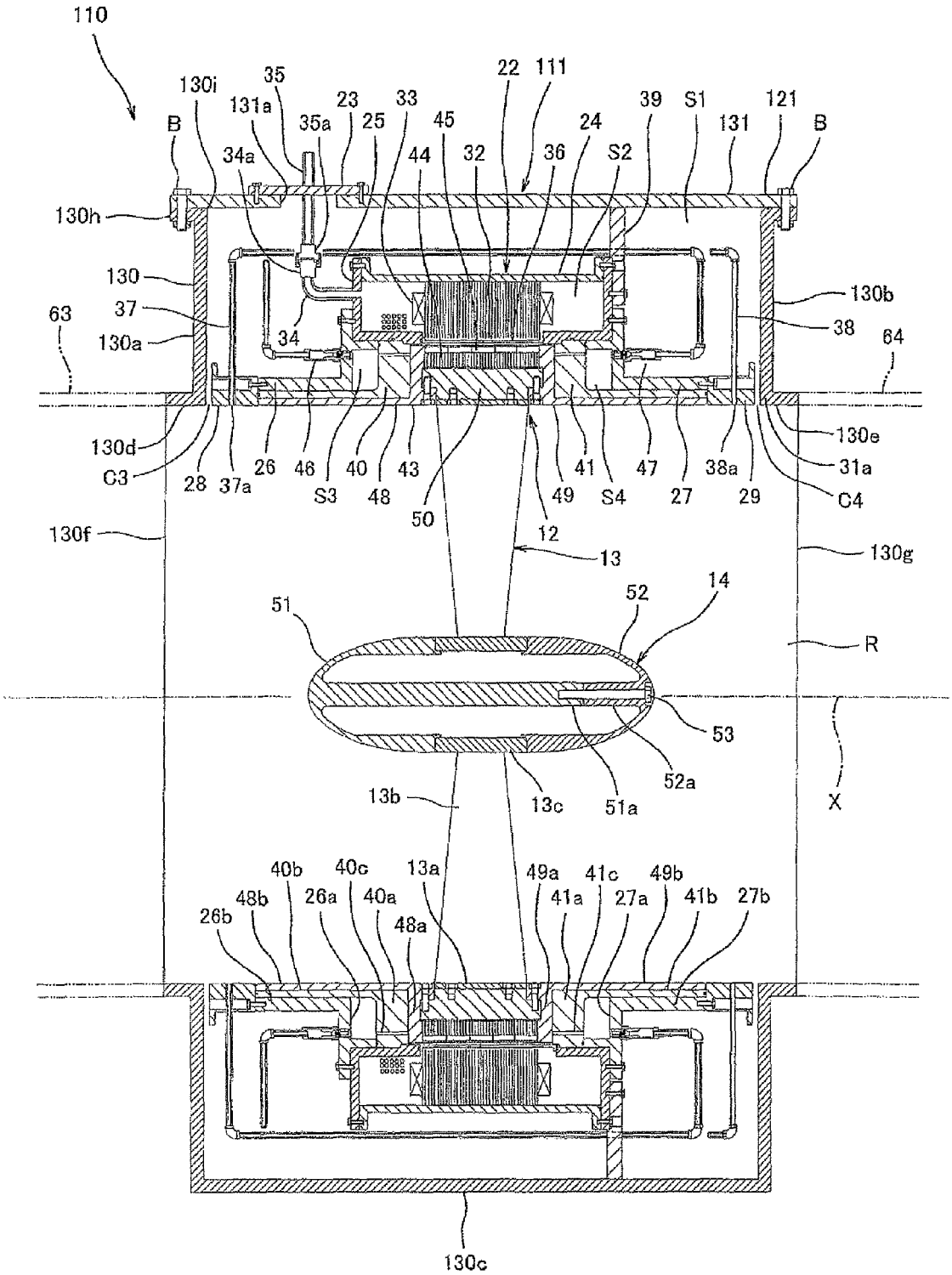
FIG. 4 is a longitudinal sectional view showing the thrust generating apparatus according to Embodiment 2 of the present invention.
Figure 5:
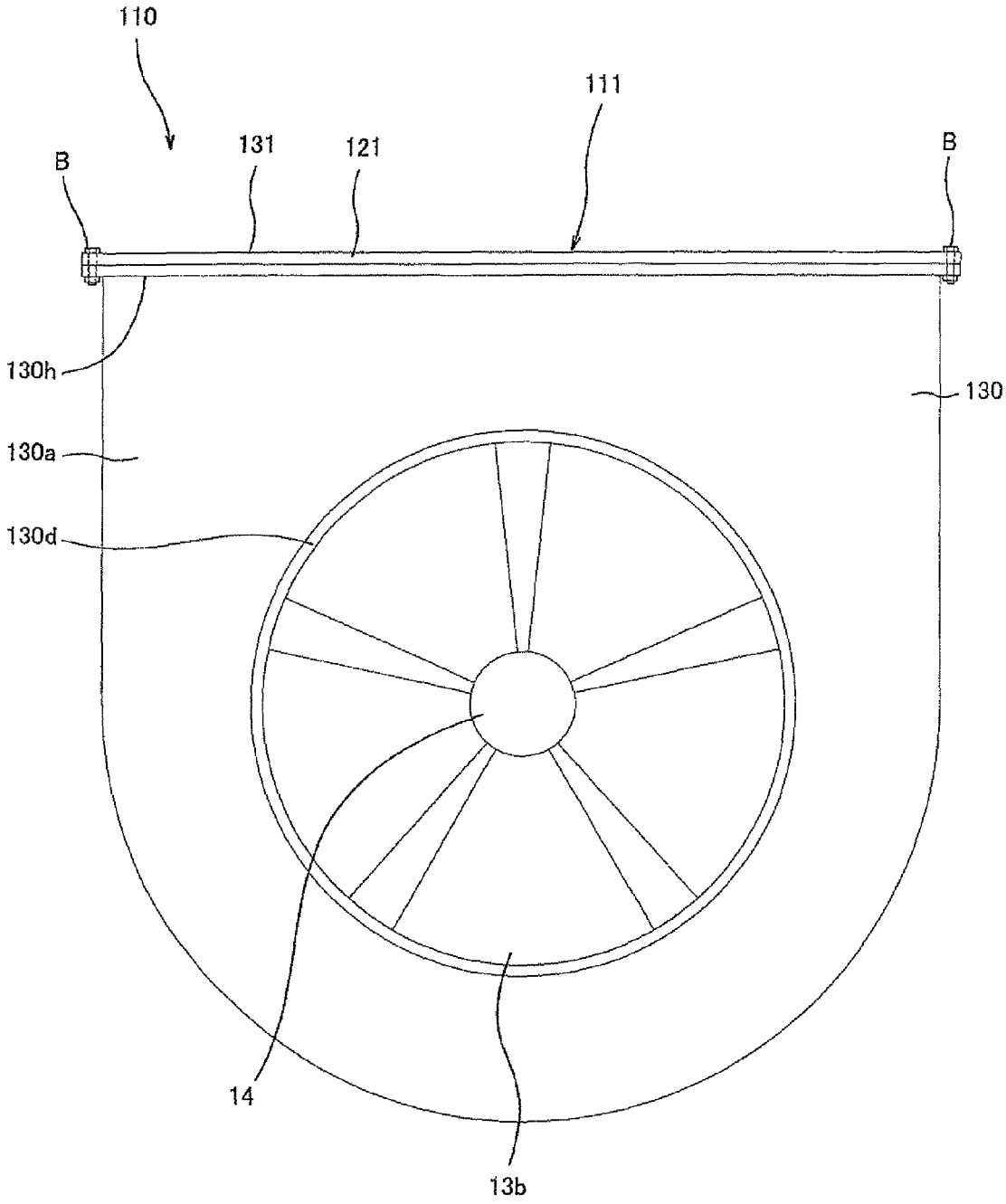
FIG. 5 is a diagram showing the thrust generating apparatus of FIG. 4 when viewed from a left side in FIG. 4.

As shown in FIGS. 4 and 5, a stator 111 of a thrust generating apparatus 110 of Embodiment 2 includes an annular outer casing 121 and an annular inner casing 22 provided on an inner periphery side of the outer casing 121. A cylindrical space formed between the outer casing 121 and the inner casing 22 is the cooling space S1. The outer casing 121 includes: a casing main body 130 including an upper surface opening 130*i*; and a cover 131 configured to close the upper surface opening 130*i* of the casing main body 130. Since components of the thrust generating apparatus 110 are the same as those of Embodiment 1 except for the outer casing 121, the same reference signs are used for the same components, and detailed explanations thereof are omitted.

The casing main body 130 includes: vertical wall portions 130*a* and 130*b* opposed to each other in the left-right direction; inner cylindrical portions 130*d* and 130*e*, each of which projects in the outward direction along the rotation axis line X and which respectively form side openings 130*f* and 130*g* of the vertical wall portions 130*a* and 130*b*; and a flange portion 130*h* formed at upper ends of the vertical wall portions 130*a* and 130*b*. The main channel R is defined by inner peripheral surfaces of the inner cylindrical portions 130*d* and 130*e*, the support rings 28 and 29, the rotor main body 43, and the outer cylindrical portion 13*a*. The cover 131 is detachably fixed to the flange portion 130*h* of the casing main body 130 by bolts B. The cover 131 is a flat plate on which a cable through hole 131*a* is partially formed. The cable through hole 131*a* is closed by the lid 23.

A gap C3 is formed between the casing main body 130 and the support ring 28, and a gap C4 is formed between the casing main body 130 and the support ring 29. The gaps C3 and C4 serve as communication ports through which the cooling space S1 communicates with the main channel R. The inner casing 22 (specifically, the second casing 25) is connected to the cover 131 of the outer casing 121 via the bracket 39 and is not fixed to the casing main body 130. Therefore, at the time of maintenance, only by detaching the bolts B and detaching the cover 131 from the casing main body 130, the components of the thrust generating apparatus 110 except for the outer casing 121 can be taken out through the upper surface opening 130*i* to the upper side.

Each of the above embodiments has explained the thrust generating apparatus which can be attached to a common large vessel. However, the thrust generating apparatus of each of the above embodiments may be attached to a movable body configured to be movable relative to the water on or under the water. The thrust generating apparatus of each of the above embodiments is applicable to submersible vessels, tugboats, and research ships and oil drilling rigs which stay at a certain position on the water. Moreover, in the above embodiments, a pump is not used as a pressure source for supplying the water to the water lubricated bearing. However, the pump may be used in a certain period (for example, in a start-up period in which the propeller blade starts rotating or in a period in which the water is forcibly supplied to the water lubricated bearing).

The invention claimed is:

1. A thrust generating apparatus provided in a liquid and configured to generate thrust by ejecting the liquid, the thrust generating apparatus comprising:

an annular stator at which a plurality of coils are provided;

a rotor capable of rotating positively and negatively and including a plurality of magnets, a rotor core to which the magnets are attached and which is constituted by a magnetic body, and an annular rotor main body to which the rotor core is attached;

a propeller blade provided on a radially inner side of the rotor main body and formed integrally with the rotor main body;

a first liquid lubricated bearing provided on one side of the rotor main body, opposed to one side surface and outer peripheral surface of the rotor main body, and configured to support a thrust load and a radial load;

a second liquid lubricated bearing provided on an other side of the rotor main body, opposed to an other side surface and outer peripheral surface of the rotor main body, and configured to support the thrust load and the radial load;

a first liquid intake port configured to open toward a portion of a channel on the one side of the rotor main body, the portion being located on one side of the propeller blade;

a second liquid intake port configured to open toward another portion of the channel on the other side of the rotor main body, the another portion being located on an other side of the propeller blade;

a first liquid conveyance tube through which the liquid having flowed through the first liquid intake port is guided to the second liquid lubricated bearing; and a second liquid conveyance tube through which the liquid having flowed through the second liquid intake port is guided to the first liquid lubricated bearing.

2. The thrust generating apparatus according to claim 1, wherein:

a check valve configured to allow only the flow of the liquid from the first liquid intake port toward the second liquid lubricated bearing is provided at the first liquid conveyance tube; and another check valve configured to allow only the flow of the liquid from the second liquid intake port toward the first liquid lubricated bearing is provided at the second liquid conveyance tube.

3. The thrust generating apparatus according to claim 1, wherein the stator includes: an outer casing; an inner casing provided on an inner periphery side of the outer casing; a cooling space formed between the outer casing and the inner casing; and communication ports through which the cooling space communicates with a main channel where the propeller blade is provided.

4. The thrust generating apparatus according to claim 3, wherein the communication ports are respectively provided on both sides of the propeller blade.

5. The thrust generating apparatus according to claim 3, wherein:

the outer casing is formed in a duct shape;

the inner casing includes fairings respectively provided on both sides of the rotor main body and each formed in a funnel shape so as to enlarge a diameter thereof in a direction away from the rotor main body; and gaps as the communication ports are respectively formed between the outer casing and a large-diameter end portion of one of the fairings and between the outer casing and a large-diameter end portion of the other fairing.

* * * * *